US011802449B2

(12) United States Patent
Skjold

(10) Patent No.: US 11,802,449 B2
(45) Date of Patent: Oct. 31, 2023

(54) PRESSURE-EQUALIZED WIRELINE APPARATUS

(71) Applicant: ICON Instruments AS, Sandnes (NO)

(72) Inventor: Jan Erik Skjold, Stavanger (NO)

(73) Assignee: ICON Instruments AS, Sandnes (NO)

( * ) Notice: Subject to any disclaimer, the term of this patent is extended or adjusted under 35 U.S.C. 154(b) by 105 days.

(21) Appl. No.: 17/298,887

(22) PCT Filed: Jan. 24, 2020

(86) PCT No.: PCT/NO2020/050012
§ 371 (c)(1),
(2) Date: Jun. 1, 2021

(87) PCT Pub. No.: WO2020/159375
PCT Pub. Date: Aug. 6, 2020

(65) Prior Publication Data

US 2022/0018199 A1 Jan. 20, 2022

(30) Foreign Application Priority Data

Jan. 29, 2019 (NO) ..... 20190107

(51) Int. Cl.
*E21B 19/084* (2006.01)
*E21B 23/14* (2006.01)
(Continued)

(52) U.S. Cl.
CPC ..... *E21B 19/084* (2013.01); *E21B 19/08* (2013.01); *E21B 23/14* (2013.01); *E21B 33/072* (2013.01); *E21B 34/06* (2013.01)

(58) Field of Classification Search
CPC ..... E21B 19/084; E21B 19/08; E21B 23/14; E21B 33/072
See application file for complete search history.

(56) References Cited

U.S. PATENT DOCUMENTS 2,630,180 A 3/1953 Summers
2,677,427 A 5/1954 Mckinney et al.
(Continued)

FOREIGN PATENT DOCUMENTS

FR 1513218 2/1968

OTHER PUBLICATIONS

International Search Report and the Written Opinion for PCT/NO2020/050012, dated Apr. 7, 2020.
(Continued)

*Primary Examiner* — Brad Harcourt
(74) *Attorney, Agent, or Firm* — ANDRUS INTELLECTUAL PROPERTY LAW, LLP

(57) ABSTRACT

A wireline apparatus is for moving a tool into or out of a well. The apparatus is configured for forming a pressure vessel in combination with at least a portion of the well. The apparatus has: a first compartment for forming part of the pressure vessel; a hoisting means, the hoisting means being placed inside the first compartment; a wireline connected to the hoisting means; a second compartment arranged inside the first compartment; an electrical motor for driving the hoisting means, the electrical motor placed inside the second compartment; and a drive shaft for connecting the motor to the hoisting means, the drive shaft extending from the motor to the hoisting means through a wall separating the first compartment and second compartment. A method is for moving the tool in the well.

7 Claims, 5 Drawing Sheets

(51) Int. Cl.

| | |
|---|---|
| ***E21B 34/06*** | (2006.01) |
| ***E21B 33/072*** | (2006.01) |
| ***E21B 19/08*** | (2006.01) |

(56) References Cited

U.S. PATENT DOCUMENTS

| | | | | |
|---|---|---|---|---|
| 2,810,439 | A | 10/1957 | Johnson et al. | |
| 3,415,317 | A * | 12/1968 | Drivet | E21B 7/12 166/336 |
| 3,517,736 | A * | 6/1970 | Waldron | E21B 33/076 166/77.1 |
| 3,602,300 | A | 8/1971 | Jaffe | |
| 4,577,693 | A | 3/1986 | Graser | |
| 9,470,054 | B2 | 10/2016 | Talgøet al. | |
| 9,926,770 | B1 | 3/2018 | Illakovwics | |
| 10,920,521 | B2 * | 2/2021 | Turner | E21B 33/0385 |
| 2003/0042019 | A1 | 3/2003 | Harkins et al. | |
| 2010/0294479 | A1 | 11/2010 | Shee | |
| 2011/0036558 | A1 * | 2/2011 | Denoix | E21B 33/072 166/77.2 |

OTHER PUBLICATIONS

Response to the first Written Opinion for PCT/NO2020/050012, dated Nov. 29, 2020.
The Second Written Opinion for PCT/NO2020/050012, dated Jan. 15, 2020.
Response to the Second Written Opinion for PCT/NO2020/050012, dated Mar. 15, 2021.
International Preliminary Report on Patentability for PCT/NO2020/050012, dated Mar. 25, 2021.

* cited by examiner

FIG. 2A
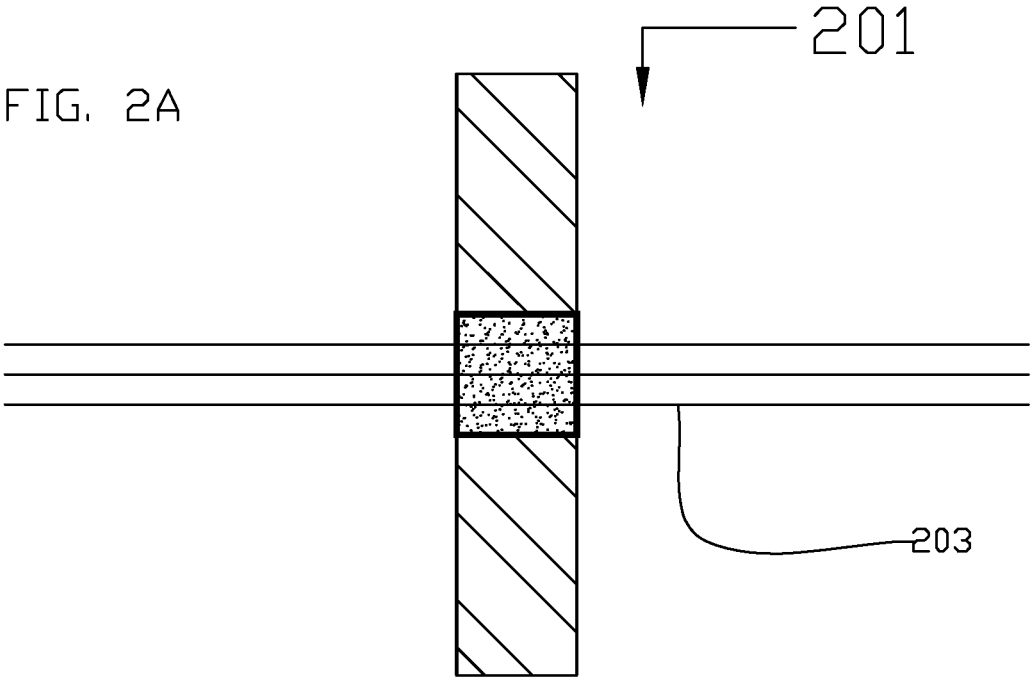
FIG. 2B
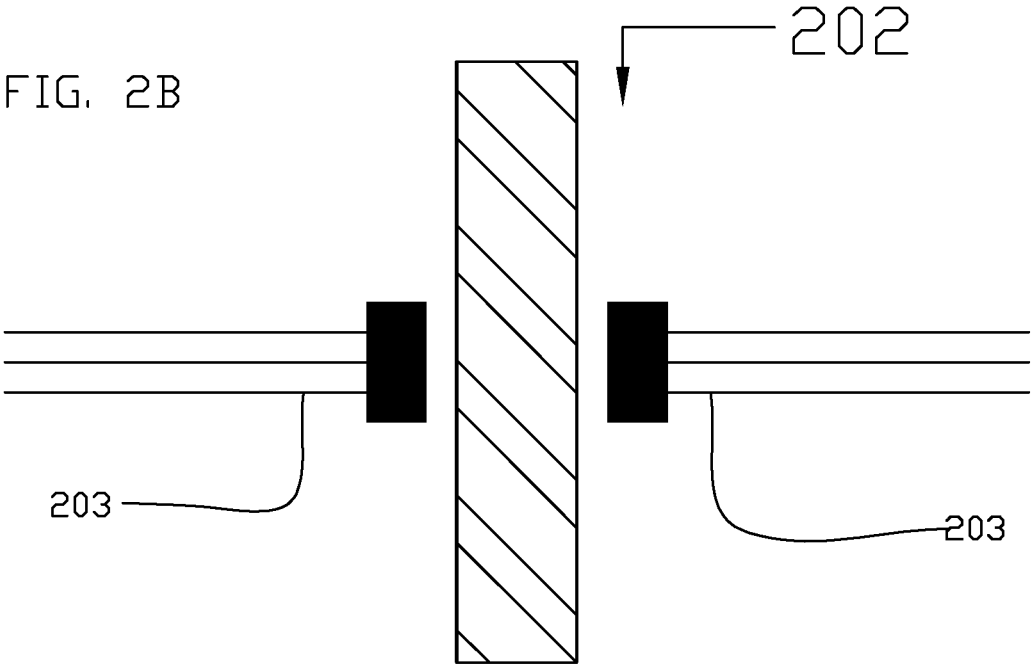
Fig. 2

PRESSURE-EQUALIZED WIRELINE APPARATUS

CROSS-REFERENCE TO RELATED APPLICATIONS

This application is the U.S. national stage application of International Application PCT/NO2020/050012, filed Jan. 24, 2020, which international application was published on Aug. 6, 2020, as International Publication WO 2020/159375 in the English language. The International Application claims priority of Norwegian Patent Application No. 20190107, filed Jan. 29, 2019. The international application and Norwegian application are both incorporated herein by reference, in entirety.

FIELD OF INVENTION

The present invention relates to the field of well intervention, and in particular to well intervention in a well for hydrocarbon extraction. The invention more particularly relates to a pressure-equalized apparatus for well intervention and a method of well intervention wherein the apparatus is utilised as part of the method.

BACKGROUND

In the field of petroleum technology, and more particularly in the field of establishing and maintaining hydrocarbon wells, well intervention is often necessary for a multitude of reasons related to well safety and/or improved production. For some well-intervention tasks, wirelines are used e.g. to lower equipment down into a well and/or for collecting equipment from a well.

There are several complicating issues while inserting tools into a pressurized well, which need to be overcome.

One issue is the need for a dynamic pressure seal through which the wire passes from the atmospheric side into the pressurised well side. Another issue is the backpressure exerted onto the wire holding the tool string passing through the pressure seal, offsetting and complicating exact metering of weight on wire.

U.S. Pat. No. 2,810,439 "Well head attachment for operating tools under pressure" introduce a pressure envelope containing wireline equipment normally attached to a well when performing intervention operations. The primary feature of this patent is overcoming the back pressure exerted by a well against wireline inserted into the well, as well as increasing safety by avoiding lubrication lengths and packers between the well and ambient pressure. An external motor connected through a pressure retaining driveshaft drives the items inside the pressure-containing envelope. This invention shows a novel way of dealing with the back-pressure issues also described in U.S. Pat. No. 2,630,180 "Line feeder for high pressure oil wells" and U.S. Pat. No. 2,677,427 "Cable injecting device".

A significant drawback of these cited patents is that they introduce need for a pressure retaining rotating shaft in order to pass mechanical motion from the outside to the inside of the pressure envelope.

The issue of back-pressure and possible leak paths has also been addressed in U.S. Pat. No. 3,602,300 "Down-hole installation, recovery and maintenance tool for wells". This introduces a novel way of avoiding mechanical pressure seals in the apparatus outer envelope by placing a hydraulic motor inside the pressure envelope with hydraulic pressure and return circuits passing through the pressure envelope and through the motor. In effect moving the rotating shaft pressure seal from the pressure envelope barrier to the motor shaft mounted within the pressure envelope.

U.S. Pat. No. 9,470,054B2 "Petroleum well intervention winch system" introduces a method of transferring drive energy magnetically coupled through the pressure housing thereby avoiding penetration of the pressure envelope. An important feature of this invention is magnetically coupling stator and rotor across a pressure barrier, with the rotor located within the pressure barrier and the stator located outside the pressure barrier. This has positive implications for safety and operability as well as regulative compliance (explosion protection and pressure safety regulations).

A drawback of U.S. Pat. No. 9,470,054B2 is that the increased gap between stator and rotor necessary to accommodate the pressure barrier between the two, leads to significant deterioration of the magnetic flux field produced by stator and surrounding the rotor. The attenuation is a result firstly of the increased distance between the rotor and the stator ($B \approx 1/r^3$), where r is the radial distance between stator and rotor and B is the magnetic flux density), and secondly by the material situated in the field forming the barrier which most likely is composed from metal. The stator field needs significant strengthening to produce adequate magnetic flux field around rotor to compensate for attenuation losses caused by the increased "r". This leads to increased stator current and by consequence larger motor compared with standard motors, limiting its practical application for small and compact systems. In addition, the inherent risk of magnetic slip in such systems means that metered stator revolutions do not necessarily correspond to rotor revolutions, providing spurious readings.

Wireline elongation caused by the combined load of spooled out wire and tool might affect correct interpretation of tool depth due to spooled out length differing from spooled in length. By measuring spooled out length and tension at point of entry, elongation compensation may be calculated thus providing actual depth.

However, wireline elongation may pose further problems due to disparity between spooled out length initially spooled in without tension and subsequently spooled in from hole with tension and corresponding elongation, if basing metering on winch turns compensated for wireline layer level alone.

This is a problem often solved by arranging a second driven sheave/pulley arrangement between the winch and the borehole, which effectively holds the load on the wireline at its entry point. The second sheave/pulley arrangement and the winch are operated synchronously such that the wireline entering or exiting the winch stays at a constant low tension allowing full wireline contraction thus ensuring no disparity between spooled in and spooled out length.

Any hoisting device, including a winch and/or any other spooling devices, sheaves or pulleys described or illustrated herein may be arranged at any angle relative to the axis of the wellbore, from vertical to horizontal.

Further a tool may be fitted with a tractor device allowing the tool to move in to or out of a well without need for use of gravity. In such case the wireline will typically be operated in a constant tension mode simply keeping the wireline taut, with the tool and tractor mechanism providing motion in or out of well.

These above-mentioned methods are known art commonly employed in the industry and therefore not discussed or illustrated further.

Another complicating issue when connecting an electrical apparatus to a tree/wellhead is the changing regulatory demands set upon the apparatus depending upon which state the apparatus is in, whether the apparatus is:

mechanically disconnected from the well;

mechanically connected to the well; or mechanically and fluidly connected to the well.

While the apparatus is disconnected from the well, only the area requirements apply. I.e. the area surrounding a tree/wellhead is commonly classed as Hazardous Area Zone 1 (potentially explosive atmosphere).

While the apparatus is mechanically connected to the well, area requirements apply to those parts of the apparatus exposed to the external environment surrounding the apparatus. I.e. the area surrounding a tree/wellhead is commonly classed as Hazardous Area Zone 1 (potentially explosive atmosphere) while the interior of the apparatus exposed to the well will be classified as Hazardous Area Zone 0 (potentially explosive atmosphere), providing an oxygen rich atmosphere is present in the interior.

While the apparatus is both mechanically and fluidly connected to the well the Hazardous Area Zone 0 (potentially explosive atmosphere) requirements per definition will only apply while the interior pressure of the well equals normal atmospheric pressure (90 to 110 kPA) and an oxygen rich atmosphere is present.

The interior pressure of a producing well will normally always be significantly higher than atmospheric pressure and in general wellhead regulative requirements such as API (American Petroleum Institute) which first and foremost concern pressure-retaining and safety issues apply.

Regulative requirements such as API, do not consider the possibility of an oxygen rich atmosphere being present in a well as this would not be a natural occurrence and thus states no specific requirements regarding potentially explosive atmospheres or equipment located within such. API generally supersedes any hazardous area requirements for items within a well.

This means items transitioning between these situations must satisfy the operating requirements for each operational state; suitability for hazardous area Zone 1, pressure retentive according to relevant well pressure rating; and immersible in any type of naturally occurring well fluid.

Further prior art is disclosed in US20100294479A1, wherein there is described a winch assembly comprising a winch chamber defined within a housing which includes an orifice to permit fluid communication with a wellbore.

SUMMARY OF THE INVENTION

According to a first aspect of the invention, there is provided a wireline apparatus for moving a tool into or out of a well, the apparatus being configured for forming a pressure vessel in combination with at least a portion of the well, the apparatus comprising: a first compartment for forming part of the pressure-containing vessel; a hoisting means, the hoisting means being placed inside the first compartment; a wireline connected to the hoisting means; a second compartment arranged inside the first compartment; an electrical motor for driving the hoisting means, the electrical motor being placed inside the second compartment; and a drive shaft for connecting the motor to the hoisting means, the drive shaft extending from the motor to the hoisting means, through a wall separating the first and the second compartment.

The hoisting means may comprise e.g. a winch, a sheave, a pulley and/or other devices suitable for the purpose of moving the tool by feeding out or pulling in the wireline.

The invention does not make use of dynamic seals such as found on conventional wireline units where the wireline passes through a series of grease seals between outside of the well and the well, or where a rotating shaft passes through the barrier separating the outside of the well and the well.

The invention specifically provides a solution to technical challenges meeting changing regulative requirements applicable when the apparatus transitions between the following states; a) disconnected from the well, b) mechanically connected to the well and c) fluidly connected to the well.

The apparatus is intended used on a topside well but may be used on any type of well including a subsea well. The well may be a hydrocarbon production well but could also be a well for hydrate production or other resource found in the ground strata.

Wireline may e.g. refer to a cabling technology used by operators of oil and gas wells to lower tools (equipment or measurement devices) into the well for the purposes of e.g. well intervention, reservoir evaluation, pipe recovery, and setting and retrieving plugs. A wireline may be a slickline, an electric line, a composite line, and/or other types of lines used for the purpose of hoisting and/or lowering a tool into a well.

The apparatus according to the first aspect of the invention advantageously comprises an electrical motor for driving the hoisting means. One advantage of using an electrical motor instead of a hydraulic motor is that static, electrical penetrations may be used instead of dynamic seals. Furthermore, an electric motor placed inside the pressure vessel allows for precise measurements of feed-out and/or pull-in from the hoisting means, as well as precise metering and control of wireline tension. Thus, the use of an electrical motor allows for more precise control of positioning of a tool in a well. Measurement of tension may derive directly from the current draw and hence torque unaffected by back pressure acting on the wireline. Motor position may be precisely determined by back-EMF measurements, Hall effect sensors, magnetic encoders, resolvers, inductive or light/laser encoders etc. Other measurements for tension may derive from instrumentation of mechanical screws, pulleys and/or sheaves.

General requirements for electrical apparatus in hazardous environments as well as requirements for well barriers typically apply in wellhead areas on petroleum production installations. Effectively both the exterior and interior of a pressure envelope deployed in a wellhead area is subject to hazardous area requirements when fluidly disconnected from the well and open to surrounding atmosphere. However, when the apparatus is connected to and forms a pressure vessel in combination with a well, only the exterior of the pressure vessel is subject to requirements for hazardous areas, while the interior is subject to well-pressure containment requirements. Regulative requirements for pressure vessels intended to contain well fluids supersede hazardous area requirements.

During the transitional phases while moving the apparatus from being fully disconnected, to being mechanically connected and then to being fluidly connected to the well, regulative requirements can be diffuse.

A general premise is however that the well may contain flammable substances (liquid or gaseous) but may not contain both said flammable substances and other prerequisites needed for combustion, such as oxygen and an ignition source. Connecting the apparatus and introducing electrical items into the volume constituting the well must therefore not alter this premise i.e. not introduce oxygen (air) and/or an ignition source.

The apparatus may have more than two compartments. A portion or an entirety of a wall of one compartment may form at least a portion of a wall of another compartment. A compartment may have a portion and/or an entirety of more than one wall in common with another compartment.

The apparatus may comprise a means for purging trapped oxygen. The means for purging oxygen may be arranged to purge oxygen from the first compartment and/or from the second compartment. The means for purging oxygen may typically be used after mechanically connecting, and prior to fluidly connecting the apparatus to the well, to remove one of the prerequisites for explosion from the environment within the apparatus and avoiding introducing oxygen to the well. "Purging trapped oxygen" means to remove oxygen and may refer to removing air or any other oxygen-rich fluid/gas mixture.

The apparatus may further comprise at least one means for pressure testing. The at least one means for pressure testing may be arranged for pressure testing the pressure vessel and/or any of the compartments of the apparatus. Pressure testing may be highly beneficial and/or necessary to ensure that the pressure vessel and/or its individual compartments are sufficiently pressure-resistant. In some embodiments, the second compartment may not need to be pressure-resistant relative to the first compartment, as it may be beneficial to have equal pressure in the first and the second compartment maintaining zero or close to zero differential pressure across the motor driveshaft seal penetrating the wall between the compartments.

The electrical motor may be submerged in fluid/liquid in the compartment. This may aid in reducing the risk of gases in the immediate surroundings of the electrical motor, so as to reduce the risk of explosion. The fluid may typically be a type of oil or other dielectric fluid.

In a preferred embodiment, the volume surrounding the electric motors stator and rotor may be filled with a dielectric fluid, while the remaining volume within the first compartment may, when the apparatus is fluidly and/or mechanically connected to the well, be filled with a fluid compatible with the well fluids e.g. water, brine etc.

Having the second compartment fluid filled may be advantageous, as it may e.g. ensure that no gases may be present within the second compartment. Further, it may be advantageous as it may e.g. ensure that the second compartment is non-compressive in relation to an pressure acting upon its outside, thereby relieving stresses to an outside wall of the second compartment, thereby reducing requirements for material thickness and/or strength.

One or more electrical and/or mechanical items within the apparatus may be constructed such that they are incapable of providing an ignition source, even with combustibles and an oxygen rich atmosphere present. Typically, this type of construction is classified intrinsically safe [i], or encapsulation [m], but cannot in any practical sense be brought to apply for a motor in this context.

The electrical motor of the apparatus may advantageously be designed and constructed such as to be pressure resistant and also to satisfy area requirements for use in hazardous areas classified as 2G ATEX (Europe) or Zone 0 or Zone 1 (USA). The motor may thus satisfy hazardous area requirements applicable when the apparatus is disconnected from a well or merely mechanically connected to the well, while also satisfying well-pressure containment requirements while being mechanically and fluidly connected to the well.

The apparatus may comprise other electrical equipment than the motor inside the apparatus/inside the first and/or second compartment. The other electrical equipment may also be designed and constructed such as to be pressure resistant and to be certifiable as incapable of igniting a flammable atmosphere. Or the equipment may be designed for operation only while the inside of the apparatus is in a non-hazardous area state. The other electrical equipment may e.g. include one or more instruments, such as one or more sensors for detecting one or more physical properties, such as position, distance, speed, proximity, or similar information related to wireline feed-out, and/or pressure, temperature and/or other characteristics of a fluid, and/or an actuator, driver, servo and/or stepper motor.

The electrical motor may comprise electronic drive circuitry that may be located within the motor, attached to the motor itself, or located separate from the motor.

A material forming at least a portion of the second compartment may be a material capable of separating a fluid in the first compartment from a fluid in the second compartment and keeping a fluid in the second compartment to keep the motor submerged in this fluid when the apparatus is hanging freely, disconnected from a well. The material may typically be e.g. plastic, fibre glass or metal.

The apparatus may be configured to form a separate pressure vessel prior to fluidly connecting to the well.

The apparatus may comprise a tool string spool and/or a quick connector. The quick connector may comprise one or more isolation valves, which may comprise one or more closing and/or shearing devices. The tool string spool may be advantageous e.g. by having the necessary space for storing a wireline tool. The quick connector may advantageously facilitate for easy connection to, and disconnection from a well and for providing an openable and/or closable barrier element, such as a valve, for opening or closing a fluid connection between the apparatus and the well.

The apparatus may further comprise a breather, to facilitate pressure equilibrium between the inside and the outside of the second compartment relative to the first compartment in the pressure vessel. This may be beneficial to reduce forces acting on the second compartment. The breather may typically be a flexible membrane, such as a movable piston, a bladder, etc. The breather may be fluid-tight in the sense that it may separate a fluid in the second compartment from a fluid in the first compartment.

According to a second aspect of the invention, there is provided a method of moving an tool in a well, the method comprising the steps of:

- providing an apparatus comprising a first compartment comprising a wireline and a hoisting means, and a second compartment comprising an electric motor, the second compartment being arranged inside the first compartment, and the motor and the wireline being connected to the hoisting means;
- connecting the apparatus to a well;
- connecting the tool to the hoisting means by use of the wireline;
- opening one or more valves to fluidly connect the apparatus to the well, so that the apparatus and at least a portion of the well in combination forms a pressure vessel;
- moving the tool by feeding out or pulling in wireline by use of the hoisting means.

The well may be a pressurised well. The well may be a well for petroleum extraction, a "petroleum well".

Prior to opening the one or more valves to fluidly connect the first compartment to the well, the first compartment may be isolated from the well.

The apparatus may comprise means for purging oxygen from the first compartment. The method may comprise the step of purging oxygen from the first compartment. The method may comprise the step of opening one or more valves so as to displace air, or any other oxygen-rich fluid, with water or another liquid or fluid to reduce the risk of explosion caused by an ignition. The step of purging oxygen from the pressure vessel may be performed prior to mechanically connecting the pressure vessel to the well and/or subsequently of mechanically connecting the pressure vessel to the well. The method may comprise the step of purging oxygen from the second compartment, from any other compartment of the apparatus and/or from the pressure vessel comprising at least a portion of the well.

The method may further comprise the step of providing measurements relating to winch feed-out. The step of providing measurements may include measurement of tension derived from current draw from the motor and/or torque, and/or back-emf measurements, and/or measurements derived from instrumented mechanical screws, pulleys and/or sheaves, and/or by use of feedback devices such as e.g. a resolver or an encoder sensor, or by use of the Hall-effect.

The apparatus may comprise driven and/or instrumented screws, pulleys, and/or sheaves, and/or feedback devices such as e.g. a resolver or an encoder sensor. These may advantageously be configured and used to obtain correct measurements related to wireline feed-out and retraction.

EMBODIMENTS OF THE INVENTION

In the following is described examples of preferred embodiments illustrated in the accompanying drawings, wherein:

FIG. 2A illustrates a first alternative for transferring power through the wall of a vessel or compartment;

FIG. 2B illustrates a second alternative for transferring power through the wall of a vessel or compartment;

Note that the illustrations are schematic and not necessarily drawn to scale.

Figure 1:
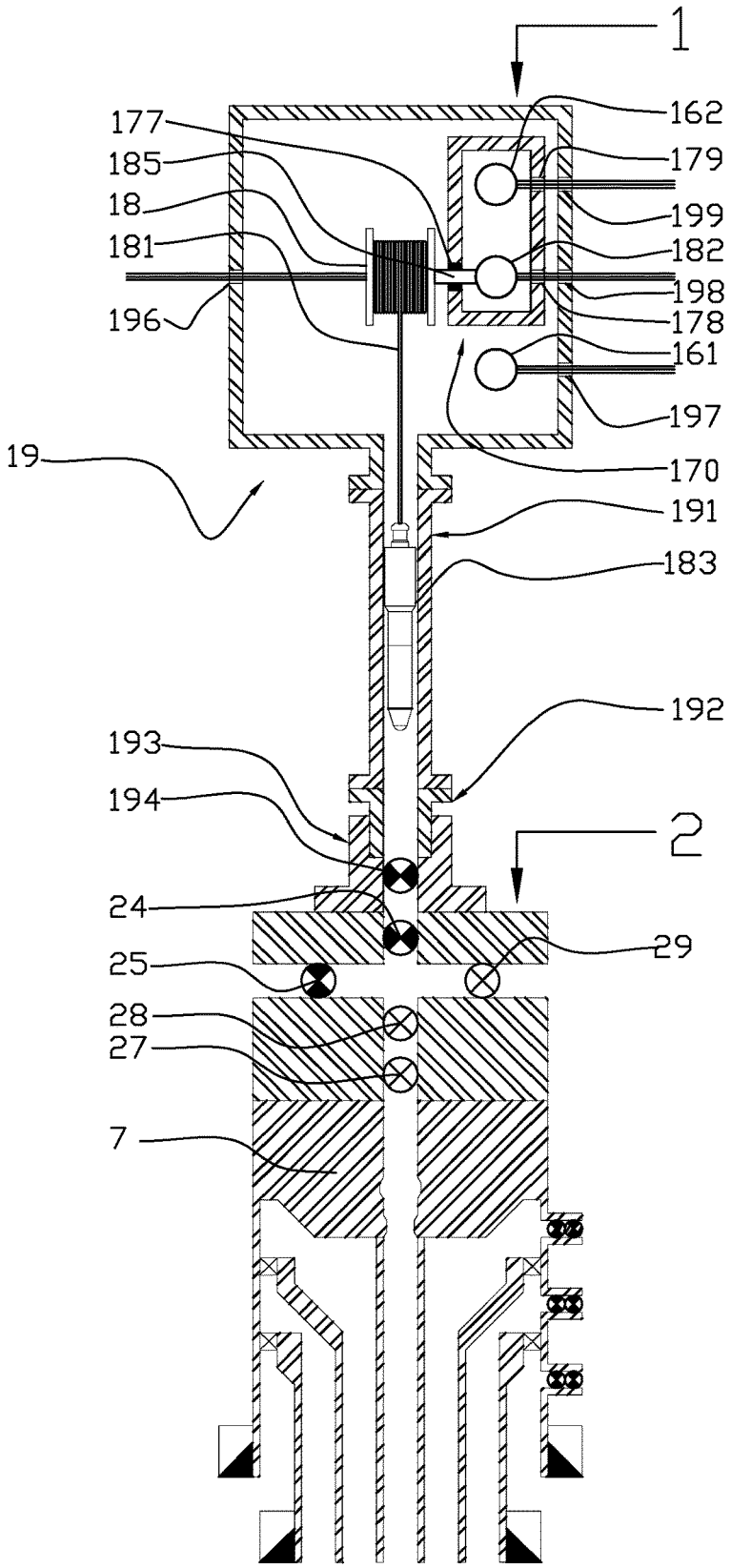
FIG. 1 illustrates an embodiment of the apparatus being mechanically connected to a well.

FIG. 1 illustrates the wireline apparatus 1 for moving a tool in to or out of a pressurised well 2 according to the first aspect of the invention. In the embodiment shown, the wireline apparatus 1 has a first compartment 19 comprising a work-string spool 191, a quick connector 192 and an isolation-valve spool 193, the first compartment 19 being configured for forming a pressure vessel in combination with a petroleum well 2. The isolation-valve spool 193 comprises an isolation valve 194 which in FIG. 1 is in a closed position. The wireline apparatus 1, in FIG. 1, is mechanically connected to a well 2, but not fluidly connected to the well 2 as the isolation valve 194 is closed.

FIG. 1 further shows the wireline apparatus 1 having a hoisting means 18, in the form of a winch 18, with a wireline 181 connected to the winch 18 and a tool 183 hanging from the wireline 181. In the illustrated situation, with the isolation valve 194 closed, the tool 183 is positioned within the work-string spool 191 of the wireline apparatus 1.

The winch 18 is arranged inside the first compartment 19, along with a first instrument 161 for measuring conditions of a fluid, such as a pressure and/or a temperature of the fluid. Furthermore, there is a second compartment 170 in the first compartment 19, the second compartment 170 forming a fluid barrier for separating a fluid outside of the second compartment 170 from a fluid inside the second compartment 170.

Inside the second compartment 170, there is an electrical motor 182 for driving the winch 18 and a second instrument 162 for measuring conditions of a fluid. The second compartment 170 is filled with liquid and purged of oxygen. By removing oxygen from the second compartment, one of the prerequisites for explosion is avoided in the immediate surroundings of the electrical motor 182 (and the second instrument 162).

There are four pressure-vessel pressure penetrators 196, 197, 198, 199 through a wall of the first compartment for allowing electrical connection to the electrical motor 182, the winch 18, the first instrument 161 and the second instrument 162 respectively. The penetrators are pressure-resistant seals, ensuring the integrity of the first compartment 19. The second compartment 170 has two penetrators 178, 179 for allowing electrical connections. The second compartment 170 further has a shaft seal 177 for a shaft 185, the shaft 185 connecting the electrical motor 182 to the winch 18 for driving the winch 18.

FIG. 1 further illustrates that the well 2 can be in a state of production while the wireline apparatus 1 is connected to the well, when the isolation valve 194 is closed, by showing a swab valve 24 and a kill valve 25 of the well 2 being closed and a manual master valve 27, a hydraulic master valve 28 and a production master valve 29 of the well 2 being open.

Although the embodiment shown uses electric conductors passing through penetrators providing electrical connections, an alternative solution is to use inductive couplers for transferring power and/or signals inductively. FIGS. 2A and 2B illustrates the use of a penetrator 201 and an inductive coupler 202 respectively. By using an inductive coupler 202, it is advantageously possible to avoid penetrations through a wall of the pressure vessel or compartment.

Both FIGS. 2A and 2B shows an electrical conductor 203 providing electrical connections. In FIG. 2A the electrical conductor 203 extends through a wall 204 through a penetrator 201, whereas in FIG. 2B a first conductor 203 leads to a first part of an inductive coupler 202, and then a second conductor 203 leads energy from a second part of the inductive coupler. The first part of the inductive coupler 202 and the second part of the inductive coupler 202 cooperates to transfer energy and/or signals through the wall 204.

Figure 3:
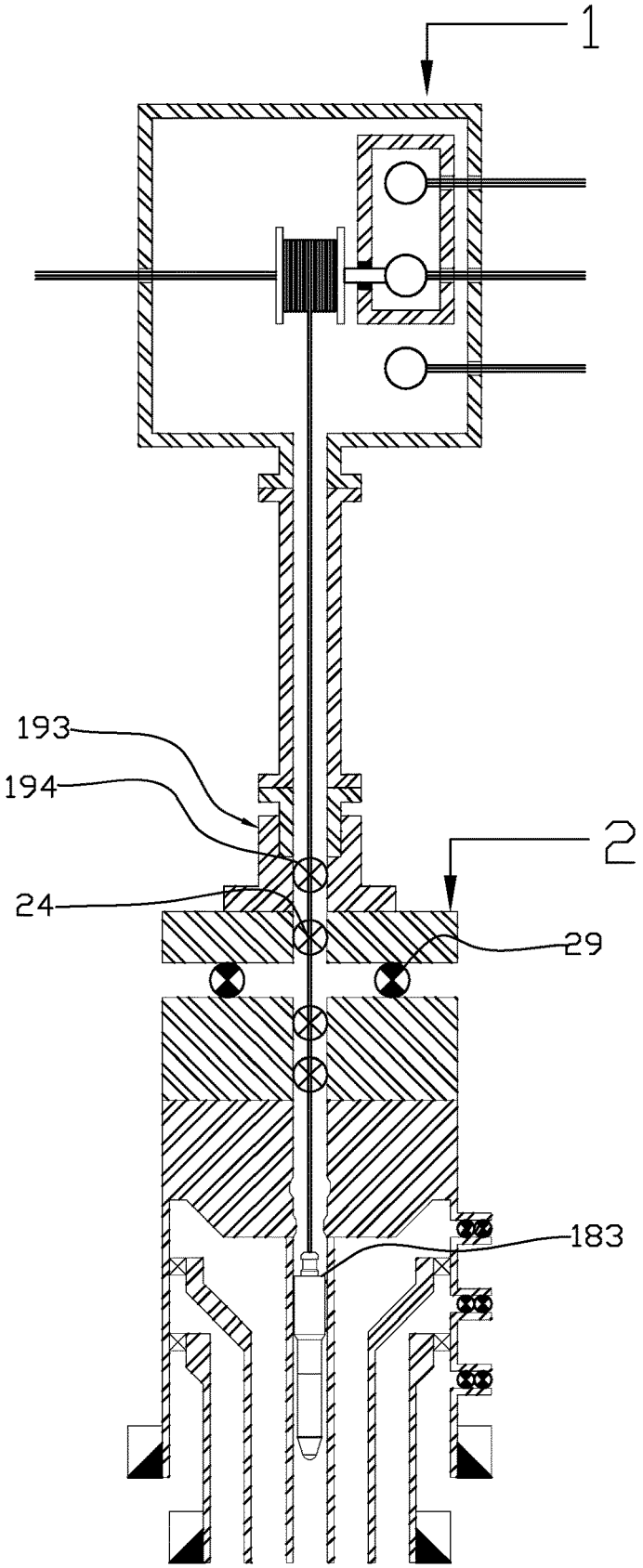
FIG. 3 illustrates an embodiment of the apparatus being fluidly connected to a well.

FIG. 3 shows the same embodiment of the invention as FIG. 1, but this time with the isolation valve 194 of the isolation-valve spool 193 and the swab valve 24 of the well 2 in open states, and thus with the wireline apparatus 1 fluidly connected to the well 2. The production master valve 29 of the well 2 is closed. The tool 183 is shown to have been lowered into the well 2.

Figure 4:
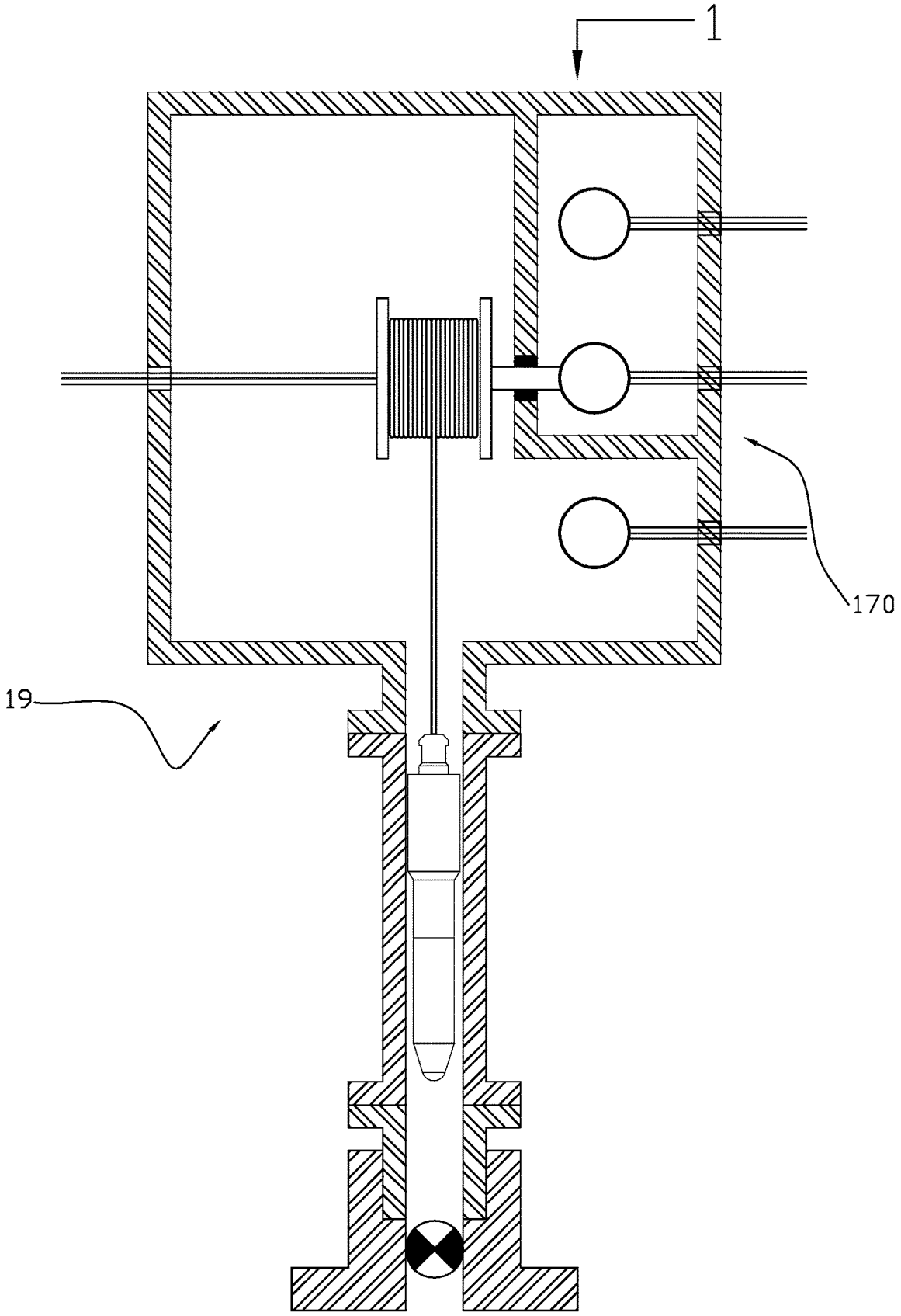
FIG. 4 illustrates an alternative embodiment of the apparatus.

FIG. 4 shows an alternative version of the wireline apparatus 1 where the first compartment 19 comprises a portion of the second compartment 170. A skilled person will understand that a multitude of configurations of the wireline apparatus 1 and its compartments are possible within the confines of the invention.

Figure 5:
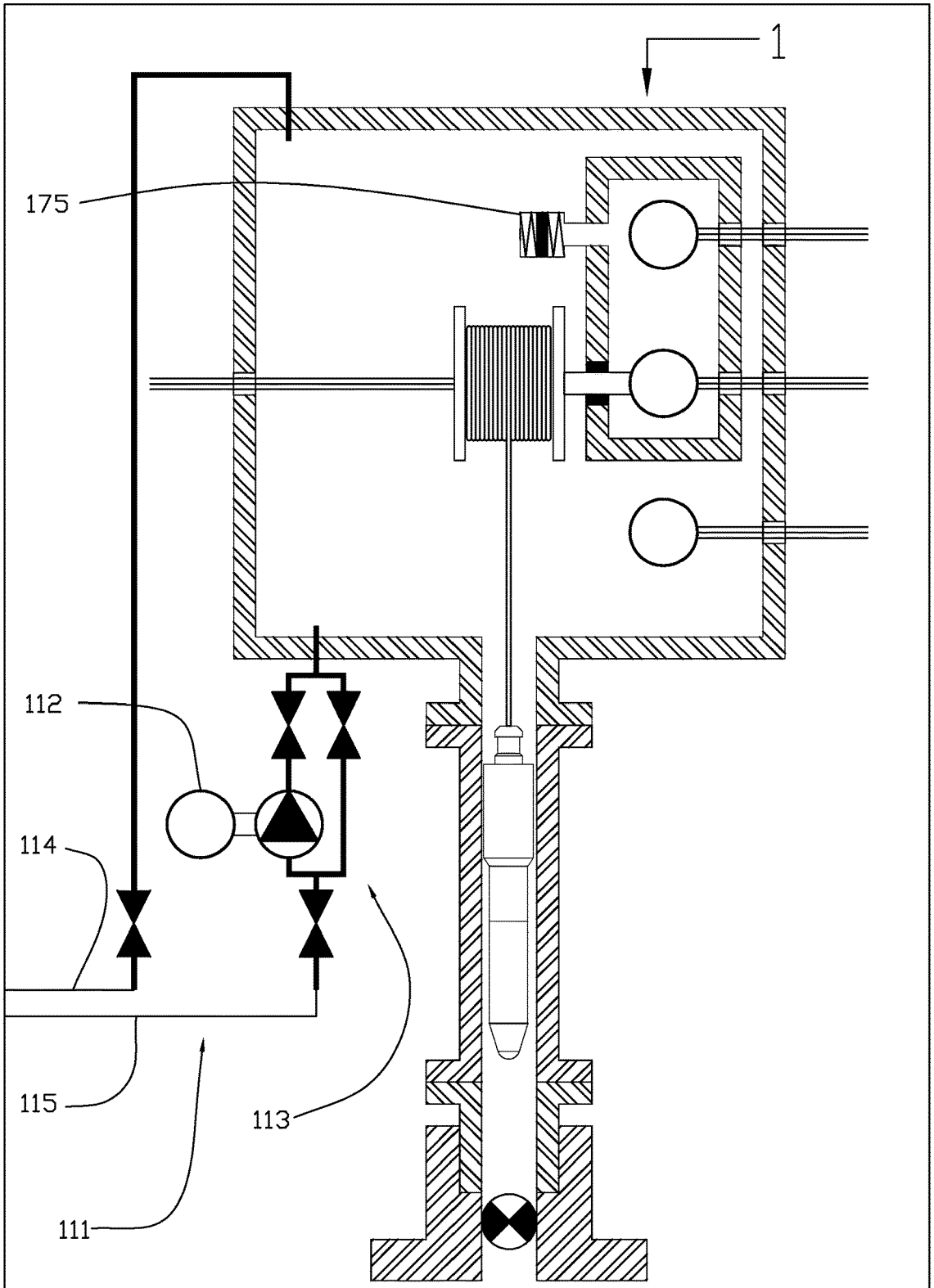
FIG. 5 illustrates an alternative embodiment of the apparatus, wherein the apparatus comprises a means for purging oxygen from the first compartment.

FIG. 5 shows another embodiment wherein the wireline apparatus 1 comprises a means for purging and pressure testing 111 connected to the first compartment 19. The means for purging and pressure testing 111 is connected to a drain through a drain line 114 and a supply of pressurized water through a water line 115. The drain and supply are not shown. The means for purging and pressure testing comprises a motor 182 and a number of valves 113.

The wireline apparatus 1 shown in FIG. 5 further shows the second compartment 170 comprising a breather 175. The second compartment 170 separates a fluid in the first compartment 190 from a fluid inside the second compartment 170, while at the same time equalising pressure between the separated fluids by allowing for a limited fluid expansion and/or contraction of the second compartment 170 through the breather 175. The breather 175 may e.g. be a balanced piston, bladder or any other commonly used item suitable for the purpose.

When the isolation valve 194 is closed, as in FIG. 5, the inside of the first compartment 19 forms a pressure vessel. The pressure vessel in the FIG. 5 comprises a fluid. By use of the means for purging and pressure testing 111, the fluid inside the pressure vessel may be purged of e.g. air and/or other potentially hazardous fluids (with respect to explosions hazard as a result of ignition), to eliminate a risk of explosion.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A wireline apparatus for moving a tool into or out of a well, the wireline apparatus being configured for forming a pressure vessel in combination with at least a portion of the well, the wireline apparatus comprising:

a first compartment for forming part of the pressure vessel;

a hoisting means, the hoisting means being placed inside the first compartment;

a wireline connected to the hoisting means;

a second compartment arranged inside the first compartment;

an electrical motor for driving the hoisting means, the electrical motor placed inside the second compartment;

a drive shaft for connecting the electrical motor to the hoisting means, the drive shaft extending from the electrical motor to the hoisting means through a wall separating the first compartment and second compartment, wherein the electrical motor is configured to be operable in a high-pressure atmosphere found inside a wellbore pressure vessel, and/or configured to be operable while submerged in liquid, and/or wherein the electrical motor is certified for use in a potentially explosive area zone, and wherein the wireline apparatus further comprises means for purging air/oxygen from the first compartment and/or the second compartment, so as to remove at least one prerequisite for explosion.

2. The wireline apparatus according to claim 1, further comprising other electrical equipment than the electrical motor inside the first compartment and/or the second compartment, the other electrical equipment including one or more sensors, an actuator, a driver, a servos, and/or a stepper motor.

3. The wireline apparatus according to claim 1, further comprising means for pressure testing the wireline apparatus.

4. The wireline apparatus according to claim 1, wherein the second compartment comprises a breather for facilitating pressure equilibrium between the second compartment and its ambient environment in the first compartment.

5. A method of moving a tool in a well, the method comprising the steps of:

providing an apparatus comprising a first compartment comprising a wireline and a hoisting means, and a second compartment comprising a motor, the second compartment being arranged inside the first compartment, and the motor and the wireline being connected to the hoisting means;

connecting the apparatus to the well;

connecting the tool to the hoisting means by use of the wireline;

opening one or more valves to fluidly connect the apparatus to the well, so that the apparatus and at least a portion of the well in combination forms a pressure vessel; and moving the tool by feeding out or pulling in wireline with the hoisting means, wherein the motor is configured to be operable in a high-pressure atmosphere found inside a wellbore pressure vessel, and/or configured to be operable while submerged in liquid, and/or wherein the motor is certified for use in a potentially explosive area zone; and purging air/oxygen from the first compartment and/or the second compartment of the apparatus so as to remove at least one prerequisite for explosion.

6. The method according to claim 5, further comprising pressure testing the apparatus prior to fluidly connecting the apparatus to the well.

7. The method according to claim 5, further comprising providing measurements relating to a feed-out from the hoisting means, wherein the measurements may include measurements of tension derived from current draw from the motor and/or a torque, and/or back-emf measurements, and/or measurements derived from instrumented mechanical screws, pulleys, and/or sheaves, and/or by use of feedback devices including a resolver or an encoder sensor, or via Hall-effect.

* * * * *